US009980071B2

(12) United States Patent
Leschka et al.

(10) Patent No.: US 9,980,071 B2
(45) Date of Patent: May 22, 2018

(54) AUDIO PROCESSOR FOR ORIENTATION-DEPENDENT PROCESSING

(71) Applicant: Fraunhofer-Gesellschaft zur Foerderung der angewandten Forschung e.V., Munich (DE)

(72) Inventors: Florian Leschka, Roettenbach (DE); Jan Plogsties, Fuerth (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days. days.

(21) Appl. No.: 15/002,047

(22) Filed: Jan. 20, 2016

(65) Prior Publication Data

US 2016/0142843 A1 May 19, 2016

Related U.S. Application Data

(63) Continuation of application No. PCT/EP2014/065430, filed on Jul. 17, 2014.

(30) Foreign Application Priority Data

Jul. 22, 2013 (EP) ..... 13177381
Mar. 20, 2014 (EP) ..... 14160878

(51) Int. Cl.
*H04R 5/02* (2006.01)
*H04S 1/00* (2006.01)
(Continued)

(52) U.S. Cl.
CPC ..... *H04S 1/002* (2013.01); *H04R 3/04* (2013.01); *H04R 5/04* (2013.01); *H04S 7/303* (2013.01);
(Continued)

(58) Field of Classification Search
CPC .. H04S 1/002; H04S 2400/03; H04S 2400/11; H04S 2400/13; H04S 2420/01;
(Continued)

(56) References Cited

U.S. PATENT DOCUMENTS 4,648,115 A * 3/1987 Sakashita ..... H04R 3/12 381/17
5,046,097 A * 9/1991 Lowe ..... H04S 1/002 381/17
(Continued)

FOREIGN PATENT DOCUMENTS

CN 1557111 A 12/2004
CN 1879450 A 12/2006
(Continued)

*Primary Examiner* — Leshui Zhang
(74) *Attorney, Agent, or Firm* — Perkins Coie LLP; Michael A. Glenn

(57) ABSTRACT

Audio processor having an input interface, a detector interface, a mixer and an output interface. The input interface receiving at least two input audio channels, each input audio channel being associated with a predetermined reproduction position of at least two loudspeakers on at least one loudspeaker axis. The detector interface receiving a position signal indicating an information on a position of the at least two loudspeakers with respect to an ear axis of a listener, wherein the ear axis and the at least one loudspeaker axis have an angle to each other, being greater than 0° and lower than 180°. The mixer mixing the at least two input audio channels to obtain the at least two output channels depending on the position signal.

9 Claims, 10 Drawing Sheets

(51) Int. Cl.
*H04R 5/04* (2006.01)
*H04R 3/04* (2006.01)
*H04S 7/00* (2006.01)

(52) U.S. Cl.
CPC ..... *H04R 2400/03* (2013.01); *H04R 2420/01* (2013.01); *H04R 2420/03* (2013.01); *H04R 2499/11* (2013.01); *H04S 2400/03* (2013.01); *H04S 2400/11* (2013.01); *H04S 2400/13* (2013.01); *H04S 2420/01* (2013.01)

(58) Field of Classification Search
CPC . H04S 7/303; H04S 5/00; H04S 1/005; H04R 3/04; H04R 5/00; H04R 5/04; H04R 2400/03; H04R 2400/11; H04R 2400/13; H04R 2420/01; H04R 2420/03; H04R 2499/11; H04R 5/033; H04R 5/02
USPC ... 381/1, 300–311, 12, 80, 81, 85, 332, 333, 381/334, 91, 123, 122, 26, 119, 120, 381/17–23; 348/480, 482, 484, E5.122, 348/E5.123, E5.125, E5.13; 353/15, 19; 700/94; 73/514.16; 704/500
See application file for complete search history.

(56) References Cited

U.S. PATENT DOCUMENTS 5,187,540 A 2/1993 Morrison et al.
5,459,790 A * 10/1995 Scofield ..... H04S 3/00 381/1
5,825,894 A * 10/1998 Shennib ..... A61B 5/121 381/17
5,870,484 A * 2/1999 Greenberger ..... H04R 5/02 381/17
6,243,476 B1 * 6/2001 Gardner ..... H04S 1/007 381/1
6,882,335 B2 * 4/2005 Saarinen ..... G06F 1/1605 345/156
7,138,979 B2 * 11/2006 Robin ..... G06F 1/1626 345/158
7,492,915 B2 * 2/2009 Jahnke ..... H04S 7/30 345/473
7,633,076 B2 * 12/2009 Huppi ..... H04M 1/72563 250/559.36
7,817,806 B2 10/2010 Nakano
8,077,888 B2 * 12/2011 Trepte ..... H04S 7/302 381/17
8,085,958 B1 * 12/2011 Trautmann ..... H04S 7/30 381/17
8,150,061 B2 * 4/2012 Ozawa ..... H04S 7/30 348/333.02
8,600,084 B1 * 12/2013 Garrett ..... H04R 5/04 381/123
2002/0164037 A1 11/2002 Sekine et al.
2006/0044419 A1 3/2006 Ozawa et al.
2006/0133623 A1 * 6/2006 Amir ..... H04R 3/00 381/92
2006/0161278 A1 * 7/2006 Maeda ..... H04M 1/0227 700/94
2006/0261247 A1 11/2006 Chen
2007/0092085 A1 * 4/2007 Katayama ..... H04S 7/307 381/17
2007/0110265 A1 * 5/2007 Kirkeby ..... G06F 1/1626 381/300
2007/0133831 A1 6/2007 Kim et al.
2008/0212786 A1 9/2008 Park et al.
2009/0116666 A1 5/2009 Ranta et al.
2009/0268936 A1 10/2009 Goldberg et al.
2010/0009721 A1 * 1/2010 Chien ..... G06F 1/1626 455/566
2010/0160004 A1 * 6/2010 Alameh ..... G06F 1/1626 455/575.1
2010/0284548 A1 11/2010 Hsu et al.
2011/0002487 A1 * 1/2011 Panther ..... H04R 5/04 381/300
2011/0045812 A1 2/2011 Kim et al.
2011/0150247 A1 * 6/2011 Oliveras ..... G06F 1/1688 381/304
2012/0051567 A1 * 3/2012 Castor-Perry ..... H04R 29/002 381/304
2012/0093323 A1 * 4/2012 Lee ..... H04S 3/00 381/23
2013/0028446 A1 1/2013 Krzyzanowski et al.
2013/0089209 A1 4/2013 Okimoto et al.
2013/0129122 A1 * 5/2013 Johnson ..... H04R 3/12 381/306
2013/0272525 A1 * 10/2013 Yoo ..... H04S 7/30 381/1
2014/0350944 A1 * 11/2014 Jot ..... G10L 19/008 704/500
2016/0219392 A1 * 7/2016 Vilermo ..... H04R 5/02

FOREIGN PATENT DOCUMENTS

CN 101257740 A 9/2008
CN 101881611 B 6/2012
CN 103024634 A 4/2013
CN 103081512 A 5/2013
DE 4224338 A1 1/1993
EP 1507439 A2 2/2005
EP 1124175 B1 7/2007
JP 2006067295 A 3/2006
JP 2006174277 A 6/2006
JP 2013085119 A 5/2013
RU 2480938 C2 4/2013
TW I260914 B 8/2006
WO 0048427 A2 8/2000
WO 2007035055 A1 3/2007
WO 2009101245 A1 8/2009
WO 2009137274 A2 11/2009
WO 2011011438 A2 1/2011
WO 2012061151 A1 5/2012
WO 2012142357 A1 10/2012
WO 2014063755 A1 5/2014

* cited by examiner

AUDIO PROCESSOR FOR ORIENTATION-DEPENDENT PROCESSING

CROSS-REFERENCE TO RELATED APPLICATIONS

This application is a continuation of copending International Application No. PCT/EP2014/065430, filed Jul. 17, 2014, which is incorporated herein by reference in its entirety, and additionally claims priority from European Application No. 13177381.4, filed Jul. 22, 2013, and from European Application No. 14160878.6, filed Mar. 20, 2014, which are also incorporated herein by reference in their entirety.

BACKGROUND OF THE INVENTION

The present invention relates to an audio processor and to a method for audio processing. Moreover, the present invention relates to an electrical device comprising such an audio processor.

In the state of the art audio processors are known which generate, for example, an output signal from an input signal, wherein at least one of the output signals may be associated with a predetermined reproduction position of a loudspeaker. Such an output signal may be applied to a fixed installed loudspeaker from an audio equipment. The loudspeakers of such an audio equipment are positioned in the room depending on the predetermined position of the loudspeaker or a predetermined main position of a listener.

For electrical devices for example tablet PCs or mobile phones the loudspeakers may also have a predetermined reproduction position. When the mobile device or the listener change the position relative to each other, the reproduction position of the loudspeakers may be wrong with respect to the listener. In the state of the art switches are known which interchange the loudspeaker signal. The switcher switches the signal which is determinate for a specific loudspeaker position to a loudspeaker which is close to the predetermined position, for example, when the position of the loudspeakers has to change at 180°, a signal for a left loudspeaker to a signal which is applied at a right loudspeaker and a signal for a right loudspeaker to a signal which is applied at a left loudspeaker.

The switcher can only switch between two conditions. Further, through the switching operation from one position to another position of the loudspeakers, the sound impression of the listener is negatively influenced.

The object of the present invention is to provide an audio processor which may provide an audio signal to a loudspeaker, wherein a loudspeaker signal for a predetermined loudspeaker position is finely tuned in respect to a listener with simultaneous consideration of a reduction of the negative influences of the sound impression through the switching process. A further object of the present invention is it to provide an electrical device which uses such an audio processor.

SUMMARY

According to an embodiment, an audio processor may have: an input interface for receiving at least two input audio channels, each input audio channel being associated with a predetermined reproduction position of two loudspeakers on a loudspeaker axis being a shortest distance between the two loudspeakers; a detector interface for receiving a position signal indicating an information on a position of the two loudspeakers with respect to an ear axis of a listener, wherein the ear axis and the loudspeaker axis have an angle to each other, being greater than 0° and lower than 180°; a mixer for mixing the two input audio channels to obtain two output channels depending on the position signal, such that a portion of a second input audio channel being a right channel in a first output channel for a first angle between the ear axis and the loudspeaker axis is greater than a portion of the second input audio channel in the first output channel for a second angle between the ear axis and the loudspeaker axis, wherein the first angle is greater than the second angle or a portion of a first input audio channel being a left channel in a second output channel for the first angle is greater than a portion of the first input audio channel in the second output channel for the second angle, wherein the first angle is greater than the second angle; and an output interface for outputting the two output channels to the two loudspeakers, wherein the input interface is configured to receive an upper left channel as a third input audio channel and an upper right channel as a fourth input audio channel, wherein the mixing is performed such that a portion of the upper left channel in the first output channel is greater than the portion of the right channel, wherein the angle is between 0° and 90° and the portion of the right channel in the second output channel is greater than the portion of the upper left channel, wherein the angle is between 0° and 90° and a portion of the upper right channel in the first output channel is greater than the portion of the left channel, wherein the angle is between 90° and 180° and the portion of the left channel in the second output channel is greater than the portion of the upper right channel, wherein the angle is between 90° and 180°, or wherein the input interface is configured to receive an upper channel, wherein the mixing is performed such that a portion of the upper channel in the first output channel is greater than the portion of the right channel, wherein the angle is between 0° and 90° and the portion of the right channel in the second output channel is greater than the portion of the upper channel, wherein the angle is between 0° and 90° and the portion of the upper channel in the first output channel is greater than the portion of the left channel, wherein the angle is between 90° and 180° and the portion of the left channel in the second output channel is greater than the portion of the upper channel, wherein the angle is between 90° and 180°, or wherein the input interface is configured to receive the left channel as the first input audio channel, the right channel as the second input audio channel, the upper left channel as the third input audio channel and the upper right channel as the fourth input audio channel wherein the mixer is configured to generate, for an angle equal to 90°, the first output channel which has in total a portion of more than 30% from the third input audio channel and more than 30% from the fourth input audio channel, and the second output channel which has in total a portion of more than 30% from the first input audio channel and more than 30% from the second input audio channel, or wherein the input interface is configured to receive the left channel as the first input audio channel, the right channel as the second input audio channel and the upper channel as a fifth input audio channel, wherein the mixer is configured to generate, for an angle equal to 90°, the first output channel which has the fifth input audio channel, and the second output channel which has a combination of the first and second input audio channel.

According to another embodiment, an electrical device may have: an audio processor as mentioned above; the two loudspeakers; and a detector for detecting the information on the position of the two loudspeakers with respect to the ear axis of the listener and for generating the position signal which is coupled to the detector interface.

According to another embodiment, a method for audio processing may have the steps of: receiving at least two input audio channels, each input audio channel being associated with a predetermined reproduction position of two loudspeakers on a loudspeaker axis being a shortest distance between the two loudspeakers; receiving a position signal indicating an information on a position of the two loudspeakers with respect to an ear axis of a listener, wherein the ear axis and the loudspeaker axis have an angle to each other, being greater than 0° and lower than 180°; mixing the at least two input audio channels to obtain two output channels depending on the position signal, such that a portion of a second input audio channel being a right channel in a first output channel for a first angle is greater than the portion of the second input audio channel in the first output channel for a second angle, wherein the first angle is greater than the second angle or a portion of a first input audio channel being a left channel in a second output channel for the first angle is greater than the portion of the first input audio channel in the second output channel for the second angle, wherein the first angle is greater than the second angle; and outputting the two output channels to the two loudspeakers, wherein an upper left channel is received as a third input audio channel and an upper right channel is received as a fourth input audio channel, wherein the mixing is performed such that a portion of the upper left channel in the first output channel is greater than the portion of the right channel, wherein the angle is between 0° and 90° and the portion of the right channel in the second output channel is greater than the portion of the upper left channel, wherein the angle is between 0° and 90° and a portion of the upper right channel in the first output channel is greater than the portion of the left channel, wherein the angle is between 90° and 180° and the portion of the left channel in the second output channel is greater than the portion of the upper right channel, wherein the angle is between 90° and 180°, or wherein an upper channel is received, wherein n the mixing is performed such that a portion of the upper channel in the first output channel is greater than the portion of the right channel, wherein the angle is between 0° and 90° and the portion of the right channel in the second output channel is greater than the portion of the upper channel, wherein the angle is between 0° and 90° and the portion of the upper channel in the first output channel is greater than the portion of the left channel, wherein the angle is between 90° and 180° and the portion of the left channel in the second output channel is greater than the portion of the upper channel, wherein the angle is between 90° and 180°, or wherein the left channel is received as the first input audio channel, the right channel is received as the second input audio channel, the upper left channel is received as the third input audio channel and the upper right channel is received as the fourth input audio channel, wherein the mixing is performed such that, for an angle equal to 90°, the first output channel which has in total a portion of more than 30% from the third input audio channel and more than 30% from the fourth input audio channel, and the second output channel which has in total a portion of more than 30% from the first input audio channel and more than 30% from the second input audio channel are generated, or wherein the input interface is configured to receive the left channel as the first input audio channel, the right channel as the second input audio channel and the upper channel as a fifth input audio channel, wherein the mixing is performed such that, for an angle equal to 90°, the first output channel which has the fifth input audio channel, and the second output channel which has a combination of the first and second input audio channel are generated.

Another embodiment may have a computer program having a program code for executing the above method, when the computer program is running on a computer or on a processor.

According to an embodiment of the invention, the audio processor comprises an input interface, a detector interface, a mixer and an output interface. The input interface receives at least two input audio channels, each input audio channel being associated with a predetermined reproduction position of at least two loudspeakers on at least one loudspeaker axis. The detector interface receives a position signal indicating an information on a position of the at least two loudspeakers with respect to an ear axis of a listener, wherein the ear axis and the at least one loudspeaker axis have an angle to each other, being greater than 0° and lower than 180° The mixer mixing the at least two input audio channels to obtain the at least two output channels depending on the position signal, such that a portion of the second input audio channel in the first output channel for a first angle between the ear axis and the loudspeaker axis is greater than a portion of the second input audio channel in the first output channel for a second angle between the ear axis and the loudspeaker axis, wherein the first angle is greater than the second angle. Further a portion of the first input audio channel in the second output channel for the first angle is greater than a portion of the first input audio channel in the second output channel for the second angle, wherein the first angle is greater than the second angle. Further also a portion of the first input audio channel in the first output channel for a first angle may be smaller than a portion of the first input audio channel in the first output channel for a second angle, wherein the first angle is greater than the second angle. Further a portion of the second input audio channel in the second output channel for a first angle may be smaller than a portion of the second input audio channel in the second output channel for a second angle, wherein the first angle is greater than the second angle. The output interface outputting the at least two output channels to the at least two loudspeakers.

The audio processor receives a position signal which indicates information on a position of the loudspeakers with respect to the ear axis of the listener. The mixer may mix for each input audio signal, which is designed for a predetermined reproduction position of a loudspeaker depending on this position signal, an output channel for each of the loudspeakers. The position signal may be generated by a detector such that the position of the listener with respect to the loudspeakers may be gathered automatically and the audio processor can compensate the difference between the predetermined reproduction position of the loudspeakers and a true position of the loudspeakers with respect to the ear axis of the listener. The mixer is able to mix the input audio signals smoother to the output channels then a switcher, which only may switch between the loudspeakers.

In an embodiment of the audio processor the input interface is configured to receive a left channel as the first input audio channel and a right channel as the second input audio channel. A portion of the left channel in the first output channel is greater than a portion of the right channel, wherein the angle is between 0° and 90°, and a portion of the right channel in the second output channel is greater than a portion of the left channel, wherein the angle is between 0° and 90°. Further, the portion of the right channel in the first output channel is greater than the portion of the left channel, wherein the angle is between 90° and 180°, and the portion of the left channel in the second output channel is greater than the portion of the right channel, wherein the angle is between 90° and 180°. Through the allocation of a main part of the left channel to the first output channel and the main part of the right channel to the second output channel for an angle which is between 0° and 90°, the first output channel can be applied to a loudspeaker on the left side and the second output channel can be applied to a loudspeaker on the right side with respect to the listener. When the angle is between 90° and 180° the main part of the right channel is allocated to the first output channel and that main part of the left channel to the second output channel. Thereby, the first output channel may be applied to a loudspeaker on the right side and the second output channel may be applied to a loudspeaker on the left side in respect to the listener, such that the predetermined position of the loudspeaker corresponds with the true position of the loudspeaker.

In an embodiment of the audio processor the input interface is configured to receive an upper left channel as the third input audio channel and an upper right channel as the fourth input audio channel. A portion of the upper left channel in the first output channel is greater than the portion of the right channel, wherein the angle is between 0° and 90°, and the portion of the right channel in the second output channel is greater than the portion of the upper left channel, wherein the angle is between 0° and 90°. Further, a portion of the upper right channel in the first output channel is greater than the portion of the left channel, wherein the angle is between 90° and 180°, and the portion of the left channel in the second output channel is greater than the portion of the upper right channel, wherein the angle is between 90° and 180°. When the angle is between 0° and 90°, the first output channel is close to the predetermined reproduction position of the upper left channel and the second output channel is close to the predetermined reproduction position of the right channel, thus for an improved sound impression the upper left channel should be applied to the first output channel and the right channel should be applied to the second output channel. Further, the first output channel is further away from the predetermined reproduction position of the right channel and the second output channel is further away from the predetermined reproduction position of the upper left channel. Thus, for an improved sound impression the right channel should not be applied to the first output channel and the upper left channel should not be applied to the second output channel. When the angle is between 90° and 180°, the first output channel is close to the predetermined reproduction position of the upper right channel and the second output channel is close to the predetermined reproduction position of the left channel, thus for an improved sound impression, the upper right channel should be applied to the first output channel and the left channel should be applied to the second output channel. Further, the first output channel is further away from the predetermined reproduction position of the left channel and the second output channel is further away from the predetermined reproduction position of the upper right channel, and thus for an improved sound impression the left channel should not be applied to the first output channel and the upper right channel should not be applied to the second output channel.

In an embodiment of the audio processor, the input interface is configured to receive an upper channel. A portion of the upper channel in the first output channel is greater than the portion of the right channel, wherein the angle is between 0° and 90°, and the portion of the right channel in the second output channel is greater than the portion of the upper channel, wherein the angle is between 0° and 90°. Further, the portion of the upper channel in the first output channel is greater than the portion of the left channel, wherein the angle is between 90° and 180°, and the portion of the left channel in the second output channel is greater than the portion of the upper channel, wherein the angle is between 90° and 180°. When the angle is between 0° and 90°, the first output channel is close to the predetermined reproduction position of the upper channel and the second output channel is close to the predetermined reproduction position of the right channel. Thus, for an improved sound impression to the listener, a greater portion of the upper channel may be applied to the first output channel and a greater portion of the right channel may be applied to the second output channel. Further, in this angle range the upper channel and the right channel may not, or just sparsely, be applied to the opposite output channels. Further, for an angle between 90° and 180°, the first output channel is still close to the predetermined reproduction position of the upper channel and the second output channel is close to the predetermined reproduction position of the left channel. Thus, for an improved sound impression to the listener, a greater portion of the upper channel may be applied to the first output channel and a greater portion of the left channel may be applied to the second output channel. Further, in this angle range may the upper channel and the left channel not, or just sparsely, be applied to the opposite output channels.

In an embodiment of the audio processor the input interface is configured to receive the left channel as the first input audio channel, the right channel as the second input audio channel, the upper left channel as the third input audio channel and the upper right channel as the fourth input audio channel. The mixer is configured to generate, for an angle equal to 90°, the first output channel and the second output channel. The first output channel comprises in total a portion of more than 30% from the third input audio channel and more than 30% from the fourth input audio channel. The second output channel comprises in total a portion of more than 30% from the first input audio channel and more than 30% from the second input audio channel. The described distribution of the portion of the input audio channels to the output channels improves the sound impression for the listener with respect to the listener's ear axis by a device with four input audio channels.

In an embodiment of the audio processor the input interface is configured to receive the left channel as the first input audio channel, the right channel as the second input audio channel and the upper channel as, for example, the fifth input audio channel. The mixer is configured to generate, for an angle equal to 90°, the first output channel which comprises the fifth input audio channel, and the second output channel which comprises a combination of the first and second input audio channel. The described distribution of the portion of the input audio channels to the output channels improves the sound impression for the listener with respect to the listener's ear axis by a device with three input audio channels.

In an embodiment of the audio processor the mixer is configured so that the portion of the second input channel in the first output channel or the portion of the first input channel in the second output channel or the portion of the first input channel in the first output channel or the portion of the second input channel in the second output channel is delayed with respect to the corresponding other portion. Through the delay a shift of the loudspeakers in parallel to the ear axis can be compensated.

In an embodiment of the audio processor the mixer comprises a matrix processor having variable matrix elements, wherein the variable matrix elements are adapted based on the position signal. A matrix processor eases the coding of the audio processor and the generating of the output channels by the processor. Depending on the number of input audio channels and output channels, matrices with various numbers of rows and various numbers of columns are realizable.

In an embodiment of the audio processor the matrix processor is configured to use complex matrix elements. Through complex matrix elements a time shifting from an audio signal may be achieved, such that the loudspeaker may be shifted in parallel to the ear axis of the listener, wherein a signal propagation delay time of the loudspeaker sound for the listener may compensated.

In an embodiment of the audio processor the mixer comprises a first adder and a second adder. The first adder adds a first processed first input audio channel and a third processed second input audio channel and the second adder adds a second processed first input audio channel and a fourth processed second input audio channel. The first processed first input audio channel is processed using a first processor having a first gain value. The second processed first input audio channel is processed using a second processor having a second gain value. The third processed second input audio channel is processed using a third processor having a third gain value. The fourth processed second input audio channel is processed using a fourth processor having a fourth gain value. The first and fourth gain values decrease between 45° and 135° and the second and the third gain values increase between 45° and 135°. The first and the second adder enable the mixer to add a plural number of input audio channels to one output channel. The input audio channels may comprise a gain value. The mixed input audio channels with gain value may be applied as an output channel to the loudspeakers.

Moreover, an electrical device is provided. The electrical device comprises an audio processor as described above, the at least two loudspeakers and a detector for detecting the information on the position of the at least two loudspeakers with respect to the ear axis of the listener and for generating the position signal which is coupled to the detector interface.

Furthermore, a method for audio processing is described. The method comprises:

- Receiving at least two input audio channels, each input audio channel being associated with a predetermined reproduction position of at least two loudspeakers on at least one loudspeaker axis.
- Receiving a position signal indicating an information on a position of the at least two loudspeakers with respect to an ear axis of a listener, wherein the ear axis and the at least one loudspeaker axis have an angle to each other being greater than 0° and lower than 180°.
- Mixing the at least two input audio channels to obtain the at least two output channels depending on the position signal, such that a portion of the second input audio channel in the first output channel for a first angle is greater than the portion of the second input audio channel in the first output channel for a second angle, wherein the first angle is greater than the second angle or
  - a portion of the first input audio channel in the second output channel for the first angle is greater than the portion of the first input audio channel in the second output channel for the second angle, wherein the first angle is greater than the second angle. And:
- Outputting the at least two output channels to the at least two loudspeakers.

Moreover, a computer program having a program code for implementing one of the above-described methods when being executed on a computer or processor is provided.

BRIEF DESCRIPTION OF THE DRAWINGS

In the following, embodiments of the present invention are described in more detail with reference to the figures, in which.

DETAILED DESCRIPTION OF THE INVENTION

Figure 1:
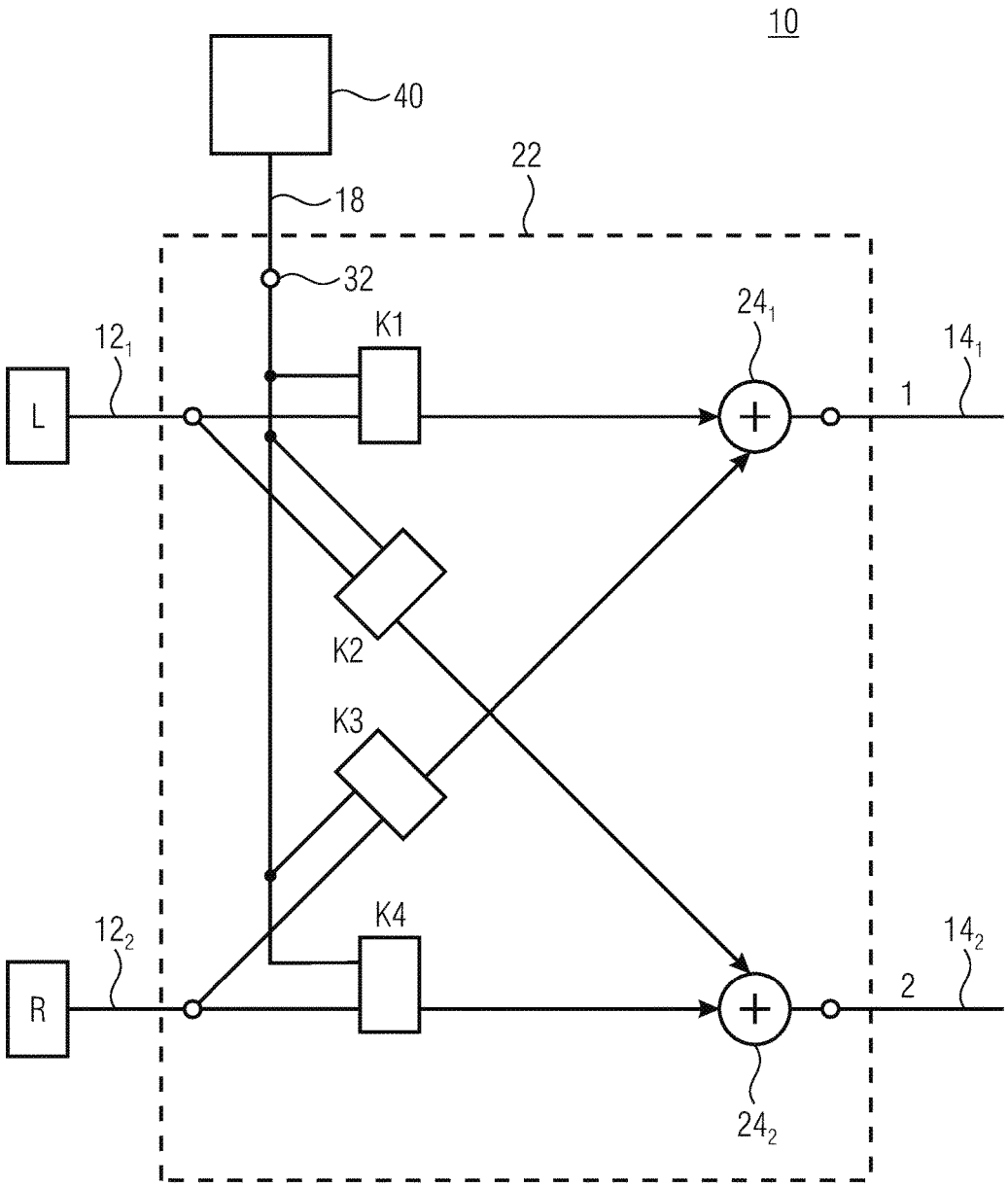
FIG. 1 shows an illustration of an audio processor with two input audio channels and two output channels.

Equal or equivalent elements or elements with equal or equivalent functionality are denoted in the following description by equal or equivalent reference numerals.

FIG. 1 shows an illustration of an audio processor according to an embodiment. The audio processor may comprise an input interface for receiving at least two input audio channels $\mathbf{12}_1$, $\mathbf{12}_2$. The input interface may comprises at least one connection point between an additional device and the audio processor 10. The additional device may for example be a sound storage device, such as a hard disk with an audio output interface or a sound generating device, for example a tuner or a microphone with an audio output interface. An audio output interface of the additional device may be connected with the input audio channel $\mathbf{12}_1$, $\mathbf{12}_2$ and may apply a sound signal, for example music, voices or further noises to the input interface.

Each of the input audio channels $\mathbf{12}_1$, $\mathbf{12}_2$ is associated with a predetermined reproduction position of at least two loudspeakers on at least one loudspeaker axis. The predetermined reproduction position of the loudspeaker may describe the position of the loudspeaker with respect a listener. The input interface may, for example, be configured to receive a left channel L as the first input audio channel $\mathbf{12}_1$ and a right channel R as the second input audio channel $\mathbf{12}_2$. The loudspeaker axis 16 describes for example the shortest connection between two loudspeakers which may receive opposite audio signals, for example a right and a left loudspeaker signal. The loudspeaker axis 16 may proceed straightly or rectangularly through an electrical device.

Further, the audio processor comprises a detector interface 32 for receiving a position signal 18. The detector interface 32 may comprise at least one connection point between a detector 40 and the audio processor 10. The detector 40 may generate the position signal 18. The position signal 18 will be explained later with reference to FIG. 2. The detector 40 may for example be an absolute-position transducer, a system which determines the position of a listener, for example with a camera, e.g. a headtracking system. The detector 40 or the detector interface 32 may for example also be coupled with a monitor of the electrical device and may change the position signal 18 depending on the monitor switching signal.

Moreover, the audio processor 10 comprises a mixer 22 for mixing the at least two input audio channels $\mathbf{12}_1$, $\mathbf{12}_2$ to obtain the at least two output channels $\mathbf{14}_1$, $\mathbf{14}_2$ depending on the position signal 18. The mixer may couple the input audio channels $\mathbf{12}_1$, $\mathbf{12}_2$ with the output channels $\mathbf{14}_1$, $\mathbf{14}_2$, wherein each coupling comprises a processor $\mathbf{34}_1$, $\mathbf{34}_2$, $\mathbf{34}_3$, $\mathbf{34}_4$. In the mixer as shown in FIG. 1, a first processor $\mathbf{34}_1$ is connected between the first input audio channel $\mathbf{12}_1$ and the first output channel $\mathbf{14}_1$.

A second processor $\mathbf{34}_2$ is connected between the first input audio channel $\mathbf{12}_1$ and the second output channel $\mathbf{14}_2$. A third processor $\mathbf{34}_3$ is connected between the second input audio channel $\mathbf{12}_2$ and the first output channel $\mathbf{14}_1$. A fourth processor $\mathbf{34}_4$ is connected between the second input audio channel $\mathbf{12}_2$ and the second output channel $\mathbf{14}_2$.

The input audio channels $\mathbf{12}_1$, $\mathbf{12}_2$ may be amplified with the gain value K1, K2, K3, K4 of the processors $\mathbf{34}_1$, $\mathbf{34}_2$, $\mathbf{34}_3$, $\mathbf{34}_4$ such that the processed input audio channel is a portion of the corresponding input audio channel $\mathbf{12}_1$, $\mathbf{12}_2$.

A first and a second adder $\mathbf{24}_1$, $\mathbf{24}_2$ may be connected between the processors $\mathbf{34}_1$, $\mathbf{34}_2$, $\mathbf{34}_3$, $\mathbf{34}_4$ and the output channels $\mathbf{14}_1$, $\mathbf{14}_2$. Each of the adders $\mathbf{24}_1$, $\mathbf{24}_2$ adding at least two processed input channels, wherein each processed input channel is processed using a processor $\mathbf{34}_1$, $\mathbf{34}_2$, $\mathbf{34}_3$, $\mathbf{34}_4$, wherein the processors $\mathbf{34}_1$, $\mathbf{34}_2$, $\mathbf{34}_3$, $\mathbf{34}_4$, process the input audio channels $\mathbf{12}_1$, $\mathbf{12}_2$, $\mathbf{12}_3$, $\mathbf{12}_4$ with a gain value K1, K2, K3, K4.

The first adder $\mathbf{24}_1$ adds the processed first and second input audio channels $\mathbf{12}_1$, $\mathbf{12}_2$ and generates the first output channel $\mathbf{14}_1$ or generates the signal which is applied to the first output channel $\mathbf{14}_1$, respectively. The second adder $\mathbf{24}_2$ adds the processed first and second input audio channels $\mathbf{12}_1$, $\mathbf{12}_2$ and generates the second output channel $\mathbf{14}_2$ or generates the signal which is applied to the second output channel $\mathbf{14}_2$, respectively.

The mixer 22 comprises the first and a second adder $\mathbf{24}_1$, $\mathbf{24}_2$. The first adder $\mathbf{24}_1$ adding a first processed first input audio channel $\mathbf{12}_1$ and a third processed second input audio channel $\mathbf{12}_2$. The second adder $\mathbf{24}_2$ adding a second processed first input audio channel $\mathbf{12}_2$ and a fourth processed second input audio channel $\mathbf{12}_2$. The first processed first input audio channel $\mathbf{12}_1$ is processed using a first processor $\mathbf{34}_1$ having a first gain value K1. The second processed first input audio channel $\mathbf{12}_1$ is processed using a second processor $\mathbf{34}_2$ having a second gain value K2. The third processed second input audio channel $\mathbf{12}_2$ is processed using a third processor $\mathbf{34}_3$ having a third gain value K3. The fourth processed second input audio channel $\mathbf{12}_2$ is processed using a fourth processor $\mathbf{34}_4$ having a fourth gain value K4. The first and fourth gain values K1, K4 decrease with an increasing angle, advantageously for an angle between 0° and 180° and more advantageously for an angle between 45° and 135°, and the second and the third gain values K2, K3 increase with an increasing angle, advantageously for an angle between 0° and 180° and more advantageously for an angle between 45° and 135°.

The gain values K1, K2, K3, K4 with which the processors $\mathbf{34}_1$, $\mathbf{34}_2$, $\mathbf{34}_3$, $\mathbf{34}_4$ processed the input audio channel may be different for each of the processors $\mathbf{34}_1$, $\mathbf{34}_2$, $\mathbf{34}_3$, $\mathbf{34}_4$ and varies depending on the position signal 18 which is applied to the processors $\mathbf{34}_1$, $\mathbf{34}_2$, $\mathbf{34}_3$, $\mathbf{34}_4$. The gain value may be adapted to the position signal 18 and may be a number between 0 and 1. If the value is nearly 0 then the portion of said input audio channel is nearly not included in the output channel. If the gain value is nearly 1 the portion of said input audio channel is nearly completely included in the output channel.

The sum of added gain values K1, K2 from the processors, for example from the processors $\mathbf{34}_1$, $\mathbf{34}_2$, which are connected with the first adder $\mathbf{24}_1$, may be constant independent of the position signal 18. The sum of added gain values from the processors $\mathbf{34}_3$, $\mathbf{34}_4$ which are connected with the second adder $\mathbf{24}_2$ may also be constant independent of the position signal 18. If the gain value K1, K2, K3, K4 is between 0 and 1, then the sum of added gain values K1, K2, K3, K4 from the processors $\mathbf{34}_1$, $\mathbf{34}_2$, $\mathbf{34}_3$, $\mathbf{34}_4$ which are connected with the first or the second adder $\mathbf{24}_1$, $\mathbf{24}_2$ may be 1. For example the processors $\mathbf{34}_1$, $\mathbf{34}_3$ are connected to the first adder $\mathbf{24}_1$, the first gain value K1 is 0.2 and the third gain value K3 is 0.8, such that the sum of the first and the third gain values K1, K3 at the first adder $\mathbf{24}_1$ is 1.

The gain value may be represented by a real number or by a complex number. A complex gain value enables the mixer 22 to delay the input audio channel. In embodiments of the invention, if the gain value is between 0 and 1, the gain value may not be a natural number, the natural numbers 0 and 1 representing an angle from 0° and 180°. The angle will be explained later with reference to FIG. 2.

The mixer 22 may comprises a matrix processor having variable matrix elements, wherein the variable matrix elements are adapted based on the position signal 18. The variable matrix element may be equal to the gain value K1, K2, K3, K4. The matrix processor eases the coding of the audio processor 10 and the generation of the output channels $\mathbf{14}_1$, $\mathbf{14}_2$ by the processors $\mathbf{34}_1$, $\mathbf{34}_2$, $\mathbf{34}_3$, $\mathbf{34}_4$. Depending on the number of the input audio channels $\mathbf{12}_1$, $\mathbf{12}_2$ and the output channels $\mathbf{14}_1$, $\mathbf{14}_2$, matrices with various numbers of rows and various numbers of columns are realizable. For example, a matrix element with four rows and two columns may be used for a matrix processor with four input audio channels $\mathbf{12}_1$-$\mathbf{12}_4$ and two output channels $\mathbf{14}_1$, $\mathbf{14}_2$. The matrix processor may also be configured to use complex matrix elements.

Further the processor comprises an output interface for outputting the at least two output channels $\mathbf{14}_1$, $\mathbf{14}_2$ to the at least two loudspeakers. The output interface may comprise at least one connection point between the audio processor 10 and the loudspeakers.

Figure 2:
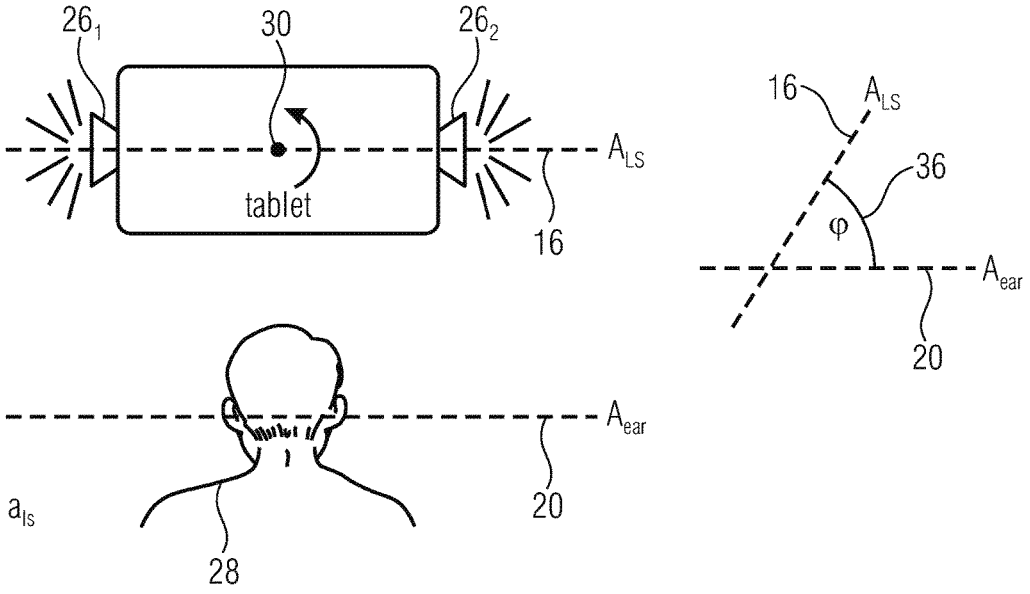
FIG. 2 shows a listener with an electrical device.

FIG. 2 shows a listener 28 with an electrical device 30. The electrical device may for example be a mobile phone (smart phone) or a tablet PC. It may also be a device like a TV, a computer or a Hi-Fi system, which stands alone in a room or is mounted on a wall, for example. The electrical device 30 may comprise an embodiment of the audio processor 10, at least two loudspeakers and a detector 40 for detecting the information on the position of the at least two loudspeakers $\mathbf{26}_1$, $\mathbf{26}_2$ with respect to the ear axis 20 of the listener 28 and for generating the position signal 18 which is coupled to the detector interface 32. The electrical device 30 shown in FIG. 2, comprises a first loudspeaker $\mathbf{26}_1$ and a second loudspeaker $\mathbf{26}_2$. The first loudspeaker $\mathbf{26}_1$ and the second loudspeaker $\mathbf{26}_2$ are arranged on the electrical device 30. The shortest distance between the first and the second loudspeaker $\mathbf{26}_1$, $\mathbf{26}_2$ represents the loudspeaker axis 16. A line between two ears of a listener 28 representing the ear axis 20. The loudspeaker axis 16 and the ear axis 20 include the angle 36. The loudspeaker axis 16 and the ear axis 20 may have any angle 36 to each other. If the angle is 0° or 180°, then the loudspeaker axis 16 and the ear axis 20 are in parallel to each other. If the angle is 0°, then a left loudspeaker may be positioned on a left side of the electrical device 30 and a right loudspeaker may be positioned on a right side of the electrical device 30 with regard to the viewing direction of the listener 28. If the angle is 180°, then the left loudspeaker may be positioned on the right side of the electrical device 30 and the right loudspeaker may be positioned on the left side of the electrical device 30 with regard to the viewing direction of the listener 28.

The position signal 18 indicates an information on a position of the at least two loudspeakers $\mathbf{26}_1$, $\mathbf{26}_2$ with respect to an ear axis of a listener 28, wherein the ear axis 20 and the at least one loudspeaker axis 16 have an angle 36 to each other being greater than 0° and lower than 180°.

Figure 3A:
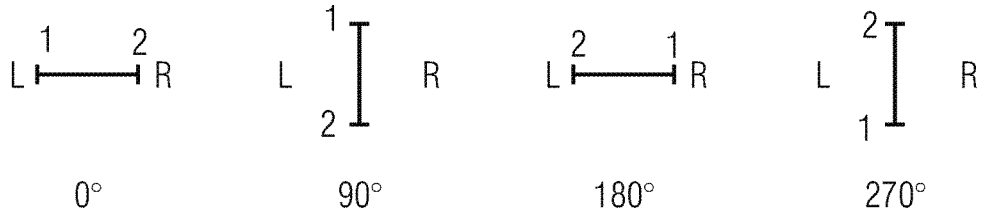
FIG. 3*a* shows an illustration of the loudspeaker axis.

FIG. 3*a* shows an illustration of the loudspeaker axis. The first loudspeaker may be arranged on position 1 and the second loudspeaker may be arranged on position 2. The four graphics represent four orientations of the loudspeaker axis. The graphics are labeled with the angle between the loudspeaker axis and the ear axis.

The input interface may be configured to receive a left channel L as the first input audio channel $\mathbf{12}_1$ and a right channel R as the second input audio channel $\mathbf{12}_2$. A portion of the left channel L in the first output channel $\mathbf{14}_1$ may be greater than a portion of the right channel R, wherein the angle is between 0° and 90° or the angle is between 270° and 360°. A portion of the right channel R in the second output channel $\mathbf{14}_2$ may be greater than a portion of the left channel L, wherein the angle is between 0° and 90° or the angle is between 270° and 360°. The portion of the right channel R in the first output channel $\mathbf{14}_1$ may be greater than the portion of the left channel L, wherein the angle is between 90° and 180° or the angle is between 180° and 270°. The portion of the left channel L in the second output channel $\mathbf{14}_2$ may be greater than the portion of the right channel R, wherein the angle is between 90° and 180° or the angle is between 180° and 270°.

Figure 3B:
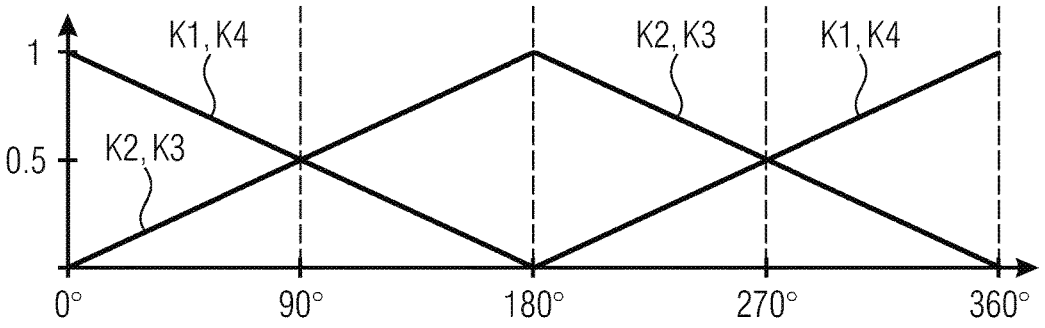
FIG. 3*b* shows an example of a line chart with four gain values for four processors.

FIG. 3*b* shows an example of a line chart with four gain values K1-K4 for the four processors for an embodiment, for example as shown in FIG. 1. The gain values K2 and K3 increase in a linear way from 0 to 1 between 0° and 180°; and decrease in a linear way from 1 to 0 between 180° and 360°. The gain values K1 and K4 decrease in a linear way from 1 to 0 between 0° and 180° and increase in a linear way from 0 to 1 between 180° and 360°.

Figure 3C:
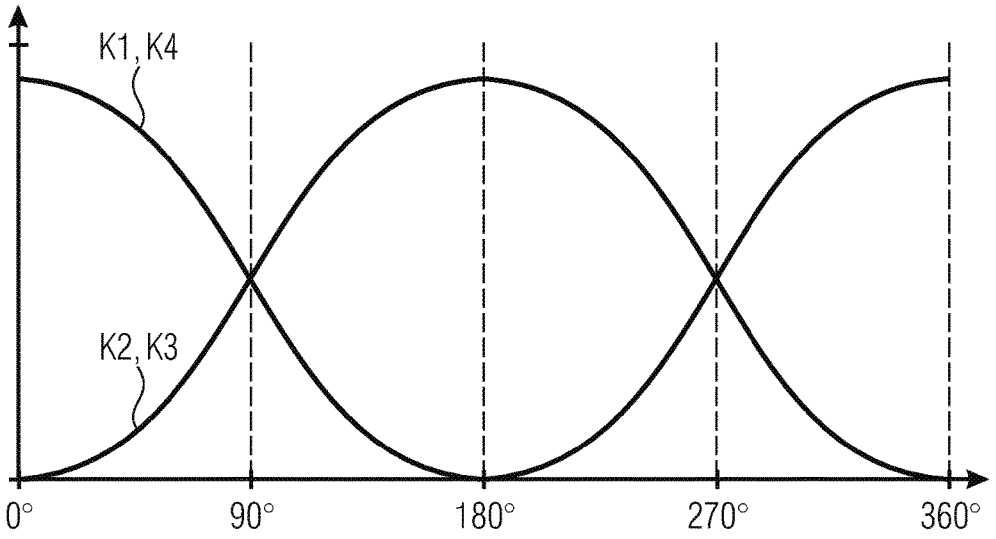
FIG. 3*c* shows a further example of a line chart with four gain values for four processors.

FIG. 3*c* shows a further example of a line chart with four gain values K1-K4 for the four processors for an embodiment, for example as shown in FIG. 1. The gain values K2 and K3 show approximately a cosine function starting from 0 at 0°, increasing to 1 at 180° and decreasing to 0 at 360°. The gain values K1 and K4 show approximately a cosine function starting from 1 at 0°, decreasing to 0 at 180° and increasing to 1 at 360°.

In general, for a first angle between the ear axis and the loudspeaker axis which is greater than a second angle between the ear axis and the loudspeaker axis, a portion of the second input audio channel $\mathbf{12}_2$ in the first output channel $\mathbf{14}_1$ for the first angle is greater than a portion of the second input audio channel $\mathbf{12}_2$ in the first output channel $\mathbf{14}_1$ for the second angle.

For an angle 36 between 90° and 180° or between 180° and 270° the portion of the second input audio channel $\mathbf{12}_2$ in the first output channel $\mathbf{14}_1$ may be greater than the portion of a first input audio channel $\mathbf{12}_1$ in the first output channel $\mathbf{14}_1$.

For an angle 36 between 0° and 180° the portion of the second input audio channel $\mathbf{12}_2$ in the first output channel $\mathbf{14}_1$ may increase and the portion of the first input audio channel $\mathbf{12}_1$ in the first output channel $\mathbf{14}_1$ may decrease.

In general, for the first angle which is greater than the second angle a portion of the first input audio channel $\mathbf{12}_1$ in the second output channel $\mathbf{14}_2$ for the first angle is greater than a portion of the first input audio channel $\mathbf{12}_1$ in the second output channel $\mathbf{14}_2$ for the second angle.

For an angle 36 between 90° and 180° or between 180° and 270° the portion of the first input audio channel $\mathbf{12}_1$ in the second output channel $\mathbf{14}_2$ may be greater than the portion of a second input audio channel $\mathbf{12}_2$ in the second output channel $\mathbf{14}_2$.

For an angle between 0° and 180° the portion of the first input audio channel $\mathbf{12}_1$ in the second output channel $\mathbf{14}_2$ may increase and the portion of the second input audio channel $\mathbf{12}_2$ in the second output channel $\mathbf{14}_2$ may decrease.

Figure 4:
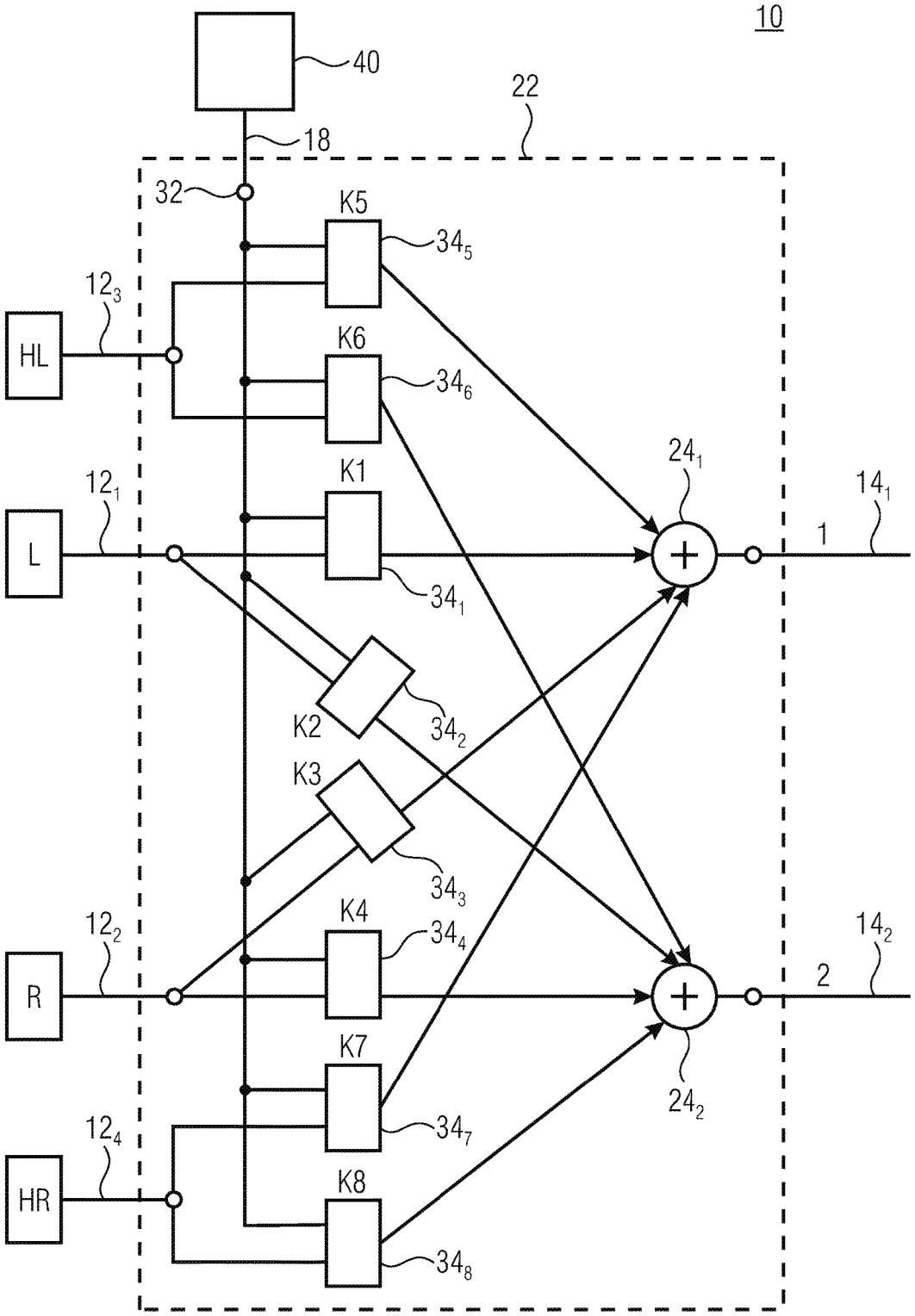
FIG. 4 shows an illustration of an audio processor according to a further embodiment.

FIG. 4 shows an illustration of an audio processor according to a further embodiment. The audio processor may comprise an input interface for receiving four input audio channels $\mathbf{12}_1$, $\mathbf{12}_2$, $\mathbf{12}_3$, $\mathbf{12}_4$. The input interface may, for example, be configured to receive a left channel L as the first input audio channel $\mathbf{12}_1$ and a right channel R as the second input audio channel $\mathbf{12}_2$, and further an upper left channel HL as the third input audio channel $\mathbf{12}_3$ and an upper right channel HR as the fourth input audio channel $\mathbf{12}_4$. The mixer in the embodiment comprises four input audio channels $\mathbf{12}_1$, $\mathbf{12}_2$, $\mathbf{12}_3$, $\mathbf{12}_4$ and generates two output channels $\mathbf{14}_1$, $\mathbf{14}_2$ depending on the position signal 18.

The mixer may couple the input audio channels $\mathbf{12}_1$, $\mathbf{12}_2$, $\mathbf{12}_3$, $\mathbf{12}_4$ with the output channels $\mathbf{14}_1$, $\mathbf{14}_2$, wherein each coupling comprises a processor $\mathbf{34}_1$, $\mathbf{34}_2$, $\mathbf{34}_3$, $\mathbf{34}_4$, $\mathbf{34}_5$, $\mathbf{34}_6$, $\mathbf{34}_7$, $\mathbf{34}_8$. In the mixer as shown in FIG. 4, a first processor $\mathbf{34}_1$ is connected between the first input audio channel $\mathbf{12}_1$ and the first output channel $\mathbf{14}_1$.

A second processor $\mathbf{34}_2$ is connected between the first input audio channel $\mathbf{12}_1$ and the second output channel $\mathbf{14}_2$. A third processor $\mathbf{34}_3$ is connected between the second input audio channel $\mathbf{12}_2$ and the first output channel $\mathbf{14}_1$. A fourth processor $\mathbf{34}_4$ is connected between the second input audio channel $\mathbf{12}_2$ and the second output channel $\mathbf{14}_2$. A fifth processor $\mathbf{34}_5$ is connected between the third input audio channel $\mathbf{12}_3$ and the first output channel $\mathbf{14}_1$. A sixth processor $\mathbf{34}_6$ is connected between the third input audio channel $\mathbf{12}_3$ and the second output channel $\mathbf{14}_2$. A seventh processor $\mathbf{34}_7$ is connected between the fourth input audio channel $\mathbf{12}_4$ and the first output channel $\mathbf{14}_1$. A eighth processor $\mathbf{34}_8$ is connected between the fourth input audio channel $\mathbf{12}_4$ and the second output channel $\mathbf{14}_2$.

The first adder $\mathbf{24}_1$ may be connected between the processors $\mathbf{34}_1$, $\mathbf{34}_3$, $\mathbf{34}_5$, $\mathbf{34}_7$, and the first output channels $\mathbf{14}_1$. The second adder $\mathbf{24}_2$ may be connected between the processors $\mathbf{34}_2$, $\mathbf{34}_4$, $\mathbf{34}_6$, $\mathbf{34}_8$ and the second output channels $\mathbf{14}_2$. Each processor $\mathbf{34}_1$, $\mathbf{34}_2$, $\mathbf{34}_3$, $\mathbf{34}_4$, $\mathbf{34}_5$, $\mathbf{34}_6$, $\mathbf{34}_7$, $\mathbf{34}_8$ processed the input audio channel $\mathbf{12}_1$, $\mathbf{12}_2$, $\mathbf{12}_3$, $\mathbf{12}_4$ with a gain value K1-K8.

The first adder $24_1$ adds a first processed first input audio channel $12_1$, a third processed second input audio channel $12_2$, a fifth processed third input audio channel $12_3$ and a seventh processed fourth input audio channel $12_4$. The second adder $24_2$ adds a second processed first input audio channel $12_1$, a fourth processed second input audio channel $12_2$, a sixth processed third input audio channel $12_3$ and a eighth processed fourth input audio channel $12_4$. The first processed first input audio channel $12_1$ is processed using a first processor $34_1$ having a first gain value K1. The second processed first input audio channel $12_1$ is processed using a second processor $34_2$ having a second gain value K2. The third processed second input audio channel $12_2$ is processed using a third processor $34_3$ having a third gain value K3. The fourth processed second input audio channel $12_2$ is processed using a fourth processor $34_4$ having a fourth gain value K4. The fifth processed third input audio channel $12_3$ is processed using a fifth processor $34_5$ having a fifth gain value K5. The sixth processed third input audio channel $12_3$ is processed using a sixth processor $34_6$ having a sixth gain value K6. The seventh processed fourth input audio channel $12_4$ is processed using a seventh processor $34_7$ having a seventh gain value K7. The eighth processed fourth input audio channel $12_4$ is processed $34_8$ using a eighth processor having an eighth gain value K8.

Figure 5A:
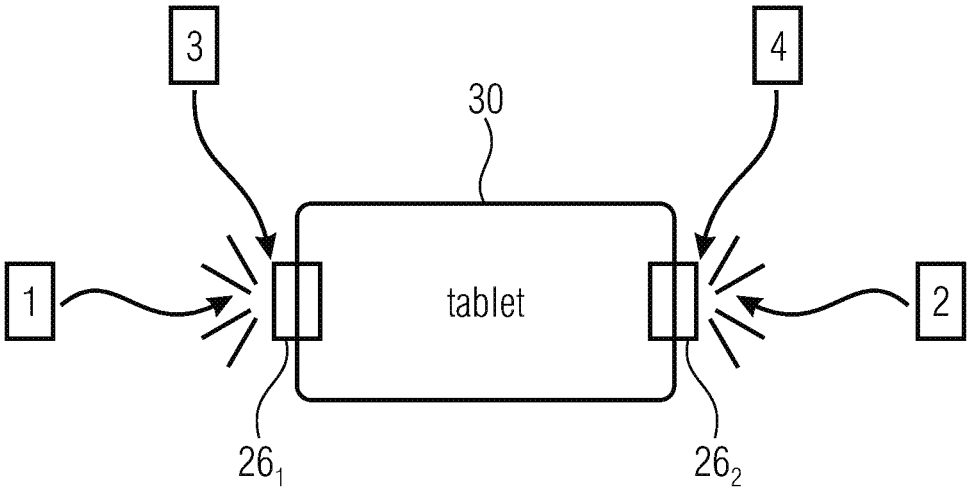
FIG. 5*a* shows an electrical device which comprises a first and second loudspeaker.

FIG. 5*a* shows an electrical device 30, for example a tablet PC, which may comprise the first loudspeaker $26_1$ and the second loudspeaker $26_2$. The loudspeakers $26_1$, $26_2$ are arranged on the loudspeaker axis on a left and on a right side of the electrical device 30. The first loudspeaker $26_1$ is on the left side of the electrical device and the second loudspeaker $26_2$ is on the right side of the electrical device. The input interface is configured to receive the left channel L as the first input audio channel $12_1$, the right channel R as the second input audio channel $12_2$, the upper left channel HL as the third input audio channel $12_3$ and the upper right channel HR as the fourth input audio channel $12_4$.

In the embodiment of FIG. 5*a* a proportion of the first and the third input audio channels $12_1$, $12_3$ in the first output channel is greater than the portion of the second and the fourth input audio channel $12_2$, $12_4$. The first output channel $14_1$ may be applied to the first loudspeaker $26_1$. Further, a proportion of the second and the fourth input audio channel $12_2$, $12_4$ in the second output channel $14_2$ is greater than the portion of the first and the third input audio channel $12_1$, $12_3$. The second output channel $14_2$ may be applied to the second loudspeaker $26_2$.

Figure 5B:
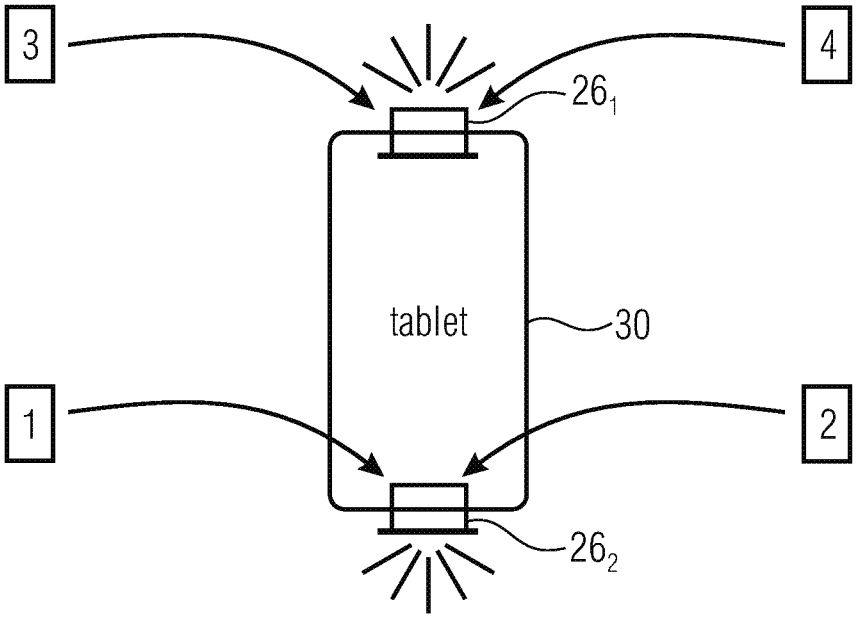
FIG. 5*b* shows the tablet PC with a 90° rotated loudspeaker axis with regard to the ear axis of the listener.

FIG. 5*b* shows the tablet PC with a 90° rotated loudspeaker axis with regard to the ear axis of the listener. The loudspeakers $26_1$, $26_2$ are arranged on one loudspeaker axis on a upper and a lower side of the electrical device 30. The first loudspeaker $26_1$ is on the upper side of electrical device 30 and the second loudspeaker $26_2$ is on the lower side of electrical device 30. In the direction of FIG. 5*b* the proportion of the third and the fourth input audio channel $12_3$, $12_4$ in the first output channel $14_1$ is greater than the portion of the first and the second input audio channel $12_1$, $12_2$. The first output channel $12_1$ is applied to the first loudspeaker $26_1$. Further a proportion of the first and the second input audio channel $12_1$, $12_2$ in the second output channel $14_2$ is greater than the portion of the third and the fourth input audio channel $12_3$, $12_4$. The second output channel $14_2$ is applied to the second loudspeaker $26_2$.

Figure 6A:
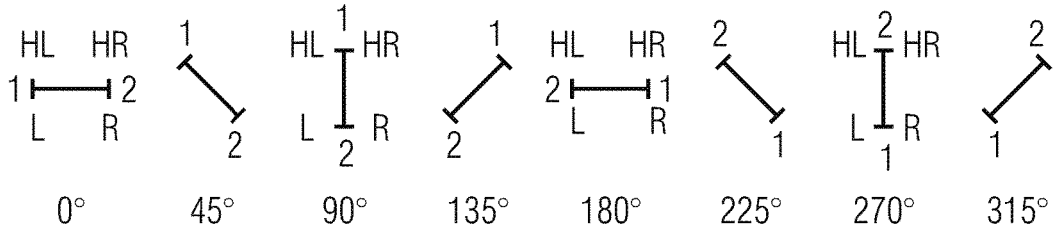
FIG. 6*a* shows an illustration of a loudspeaker axis.

FIG. 6*a* shows an illustration of a loudspeaker axis. The first loudspeaker may be arranged on position 1 and the second loudspeaker may be arranged on position 2. The eight graphics represent eight orientations of the loudspeaker axis. The graphics are labeled with the angle between the loudspeaker axis and the ear axis.

The input interface is configured to receive the left channel L as the first input audio channel $12_1$, the right channel R as the second input audio channel $12_2$, the upper left channel HL as the third input audio channel $12_3$ and the upper right channel HR as the fourth input audio channel $12_4$.

Figure 6B:
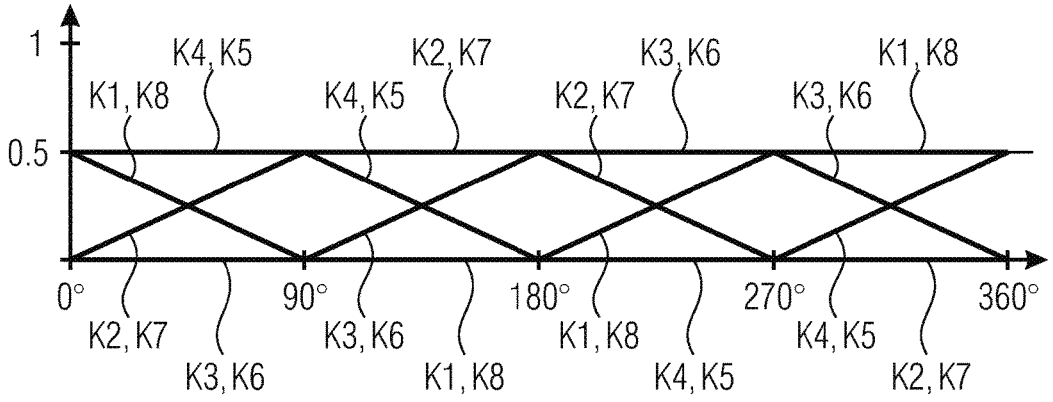
FIG. 6*b* shows a first example of a line chart with gain values for an embodiment as shown in FIG. 4.
Figure 6C:
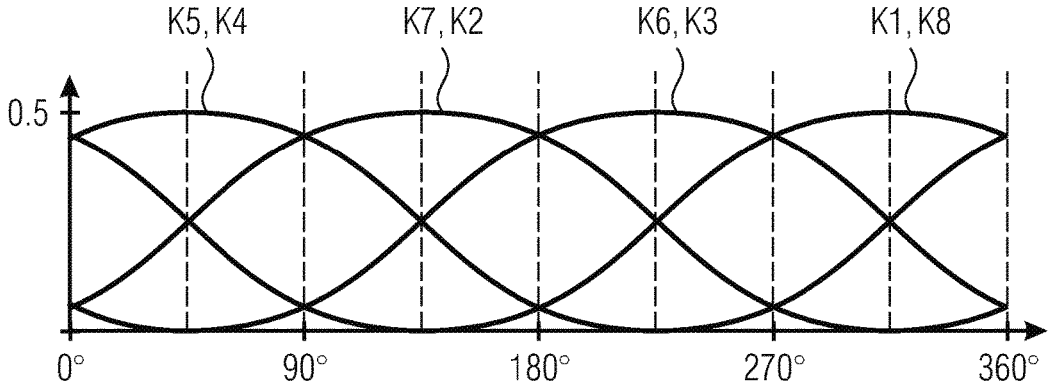
FIG. 6*c* shows a second example of a line chart with gain values for an embodiment as shown in FIG. 4.

FIG. 6*b* shows a first example of a line chart with gain values for an embodiment as shown in FIG. 4. FIG. 6*c* shows a second example of a line chart with gain values for an embodiment as shown in FIG. 4. Both examples of line charts comprise eight gain values K1-K8 for the eight processors.

For a first angle between the ear axis and the loudspeaker axis, which is greater than a second angle between the ear axis and the loudspeaker axis, a portion of the second input audio channel $12_2$ in the first output channel $14_1$ for the first angle is greater than a portion of the second input audio channel $12_2$ in the first output channel $14_1$ for the second angle.

In general, for the first angle, which is greater than the second angle, a portion of the first input audio channel $12_1$ in the second output channel $14_2$ for the first angle is greater than a portion of the first input audio channel $12_1$ in the second output channel $14_2$ for the second angle.

A portion of the upper left channel in the first output channel is greater than the portion of the right channel, wherein the angle is between 0° and 90°, and the portion of the right channel in the second output channel is greater than the portion of the upper left channel, wherein the angle is between 0° and 90°. Further a portion of the upper right channel in the first output channel is greater than the portion of the left channel, wherein the angle is between 90° and 180°, and the portion of the left channel in the second output channel is greater than the portion of the upper right channel, wherein the angle is between 90° and 180°.

The first and fourth gain values decrease with an increasing angle, advantageously for an angle between 0° and 180° and more advantageously for an angle between 45° and 135°. The second and the third gain values increase with an increasing angle, advantageously for an angle between 0° and 180° and more advantageously for an angle between 45° and 135°.

Further, the mixer 22 is configured to generate, for an angle equal to 90°, the first output channel, which comprises in total a portion of more than 30%, in an embodiment more than 45% or 50%, of the third input audio channel and more than 30%, in an embodiment more than 45% or 50%, of the fourth input audio channel, and the second output channel, which comprises in total a portion of more than 30%, in an embodiment more than 45% or 50%, of the first input audio channel and more than 30%, in an embodiment more than 45% or 50%, of the second input audio channel.

Figure 7:
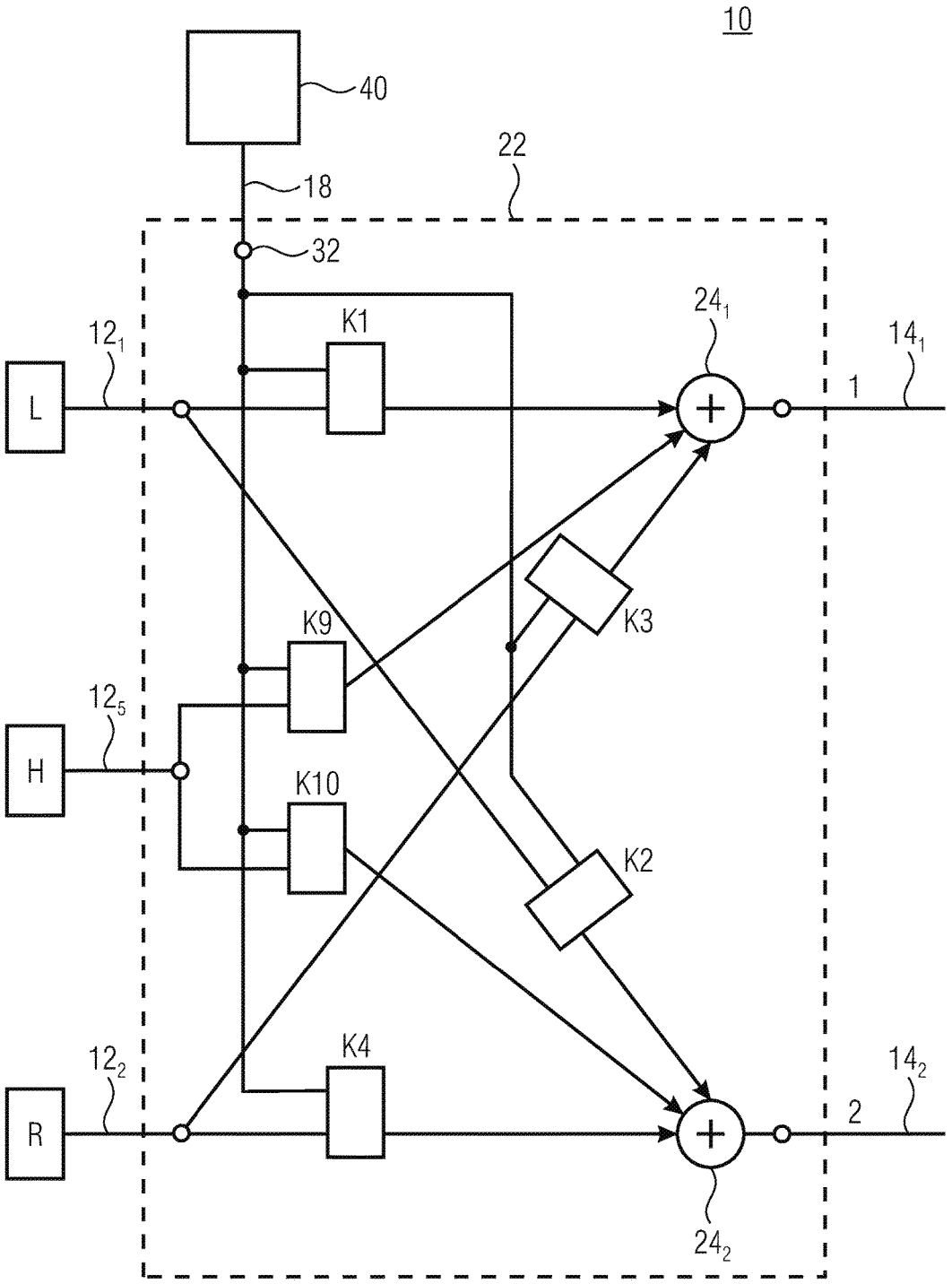
FIG. 7 shows an illustration of an audio processor according to a further embodiment.

FIG. 7 shows an illustration of an audio processor according to a further embodiment. The audio processor may comprise an input interface for receiving three input audio channels $12_1$, $12_2$, $12_5$. The input interface may, for example, be configured to receive the left channel L as the first input audio channel $12_1$, the right channel R as the second input audio channel and an upper channel H as the for example fifth input audio channel $12_5$. The mixer in the embodiment comprises three input audio channels $12_1$, $12_2$, $12_5$, and generates two output channels $14_1$, $14_2$ depending on the position signal 18.

The mixer may couple the input audio channels $12_1$, $12_2$, $12_5$ with the output channels $14_1$, $14_2$, wherein each coupling comprises a processor $34_1$, $34_2$, $34_3$, $34_4$, $34_9$, $34_{10}$. In the mixer as shown in FIG. 7, a first processor $34_1$ is connected between the first input audio channel $12_1$ and the first output channel $14_1$. A second processor $34_2$ is connected between the first input audio channel $12_1$ and the second output channel $14_2$. A third processor $34_3$ is connected between the second input audio channel $12_2$ and the first output channel $14_1$. A fourth processor $34_4$ is connected between the second input audio channel $12_2$ and the second output channel $14_2$. A ninth processor $34_9$ is connected between the fifth input audio channel $12_5$ and the first output channel $14_1$. A tenth processor $34_{10}$ is connected between the fifth input audio channel $12_5$ and the second output channel $14_2$.

The first adder $24_1$ may be connected between the processors $34_1$, $34_3$, $34_9$, and the first output channel $14_1$. The second adder $24_2$ may be connected between the processors $34_2$, $34_4$, $34_{10}$ and the second output channel $14_2$. Each processor $34_1$, $34_2$, $34_3$, $34_4$, $34_9$, $34_{10}$, processed the input audio channel $12_1$, $12_2$, $12_5$ with a gain value K1, K2, K3, K4, K9, K10.

The first adder $24_1$ adds a first processed first input audio channel $12_1$, a third processed second input audio channel $12_2$ and a ninth processed fifth input audio channel $12_5$. The second adder $24_2$ adds a second processed first input audio channel $12_1$, a fourth processed second input audio channel $12_2$ and a tenth processed fifth input audio channel $12_5$.

The first processed first input audio channel $12_1$ is processed using a first processor $34_1$ having a first gain value K1. The second processed first input audio channel $12_1$ is processed using a second processor $34_2$ having a second gain value K2. The third processed second input audio channel $12_2$ is processed using a third processor $34_3$ having a third gain value K3. The fourth processed second input audio channel $12_2$ is processed using a fourth processor $34_2$ having a fourth gain value K4. The ninth processed fifth input audio channel $12_5$ is processed using a ninth processor $34_9$ having a ninth gain value K9. The tenth processed fifth input audio channel $12_5$ is processed using a tenth processor $34_{10}$ having a tenth gain value K10.

Figure 8A:
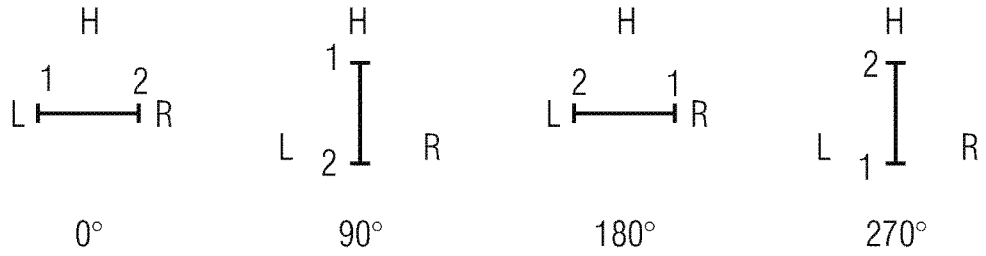
FIG. 8*a* shows an illustration of a loudspeaker axis.

FIG. 8*a* shows an illustration of a loudspeaker axis. The first loudspeaker may be arranged on position 1 and the second loudspeaker may be arranged on position 2. The four graphics represent four orientations of the loudspeaker axis. The graphics are labeled with the angle between the loudspeaker axis and the ear axis.

The input interface may, for example, be configured to receive the left channel L as the first input audio channel $12_1$, the right channel R as the second input audio channel and an upper channel H as, may be, the fifth input audio channel $12_5$.

Figure 8B:
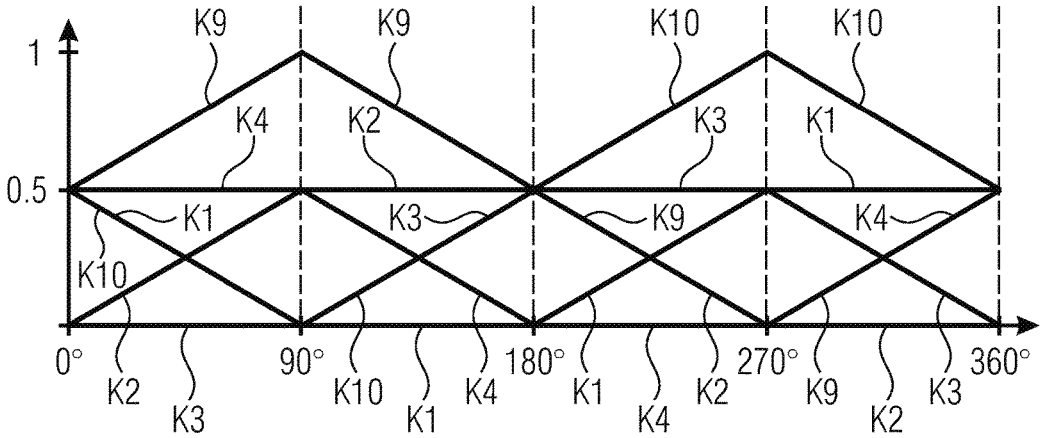
FIG. 8*b* shows a first example of a line chart with gain values for an embodiment as shown in FIG. 7.
Figure 8C:
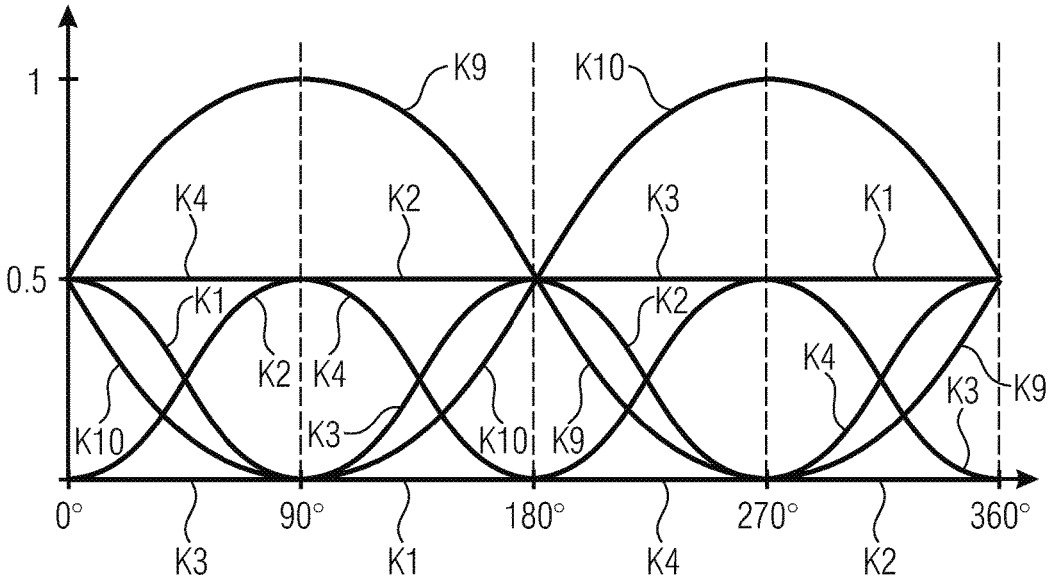
FIG. 8*c* shows a second example of a line chart with gain values for an embodiment as shown in FIG. 7.

FIG. 8*b* shows a first example of a line chart with gain values for an embodiment as shown in FIG. 7. FIG. 8*c* shows a second example of a line chart with gain values for an embodiment as shown in FIG. 7. Both examples of line charts comprise six gain values K1, K2, K3, K4, K9, K10 for the six processors.

For a first angle between the ear axis and the loudspeaker axis which is greater than a second angle between the ear axis and the loudspeaker axis a portion of the second input audio channel $12_2$ in the first output channel $14_1$ for the first angle is greater than a portion of the second input audio channel $12_2$ in the first output channel $14_1$ for the second angle.

For the first angle, which is greater than the second angle, a portion of the first input audio channel $12_1$ in the second output channel $14_2$ for the first angle is greater than a portion of the first input audio channel $12_1$ in the second output channel $14_2$ for the second angle.

As shown in FIG. 8*b* and FIG. 8*c*, a portion of the upper channel in the first output channel is greater than the portion of the right channel, wherein the angle is between 0° and 90°, and the portion of the right channel in the second output channel is greater than the portion of the upper channel, wherein the angle is between 0° and 90°. Further, the portion of the upper channel in the first output channel is greater than the portion of the left channel, wherein the angle is between 90° and 180°, and the portion of the left channel in the second output channel is greater than the portion of the upper channel, wherein the angle is between 90° and 180°.

The first and fourth gain values decrease with an increasing angle, advantageously for an angle between 0° and 180°, and the second and the third gain values increase with an increasing angle, advantageously for an angle between 0° and 180°.

Further, the mixer may configured to generate, for an angle equal to 90°, the first output channel which comprises the fifth input audio channel, and the second output channel which comprises a combination of the first and second input audio channel.

The sum of the added gain values which are applied to the first adder and the sum of the added gain values which are applied to the second adder may be 1 for each of the adders if the possible gain value is between 0 and 1. If only one loudspeaker is arranged on a loudspeaker axis, for example the upper loudspeaker on the fifth input audio channel, then the gain values K9, K10 of the processors which are coupled to said input audio channel may be between 0 and 1. If two loudspeakers are arranged on a loudspeaker axis, for example the left and the right loudspeakers on the first and the second input audio channels, then the gain values K1-K4 of the processors which are coupled to said input audio channels may between 0 and 0.5.

Figure 9:
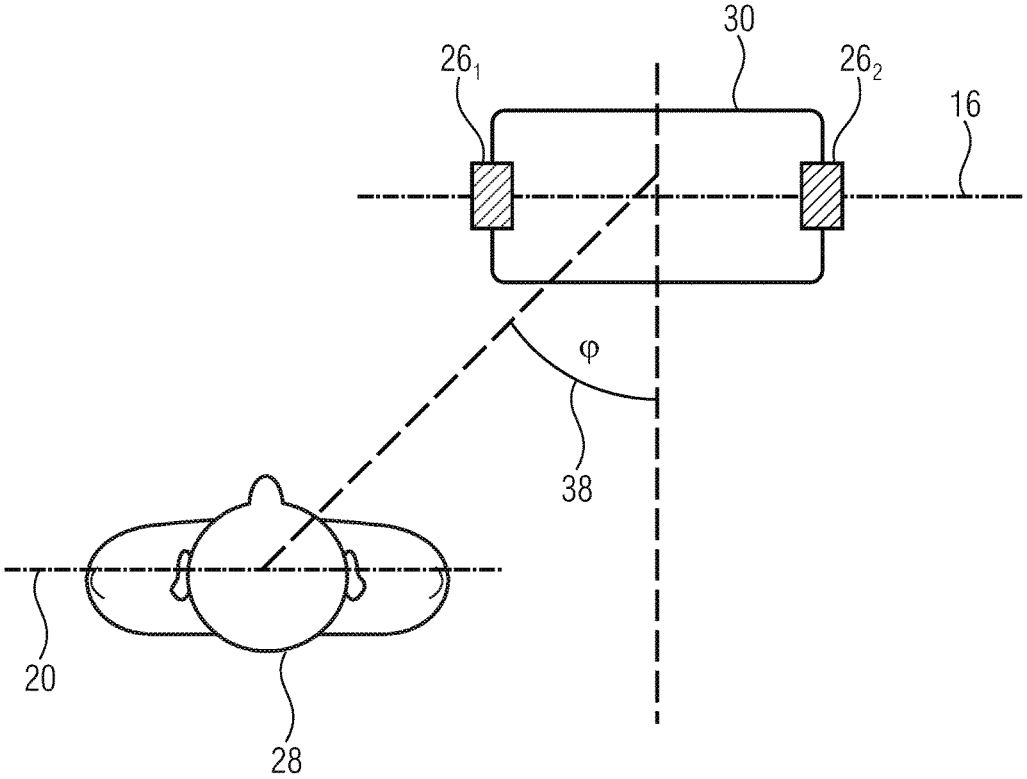
FIG. 9 shows an electrical device with a loudspeaker axis which is in parallel to the ear axis of the listener.

FIG. 9 shows an electrical device 30 with a loudspeaker axis 16 which is in parallel to the ear axis 20 of the listener 28. The electrical device 30 is shifted along the loudspeaker axis 16, such that for example the first loudspeaker $26_1$ which received the first output channel and the second loudspeaker $26_2$ which received the second output channel are not in front of the listener 28. The input interface may be configured to receive a left channel as the first input audio channel and a right channel as the second input audio channel. The mixer may be configured so that the portion of the second input channel in the first output channel or the portion of the first input channel in the second output channel or the portion of the first input channel in the first output channel or the portion of the second input channel in the second output channel is delayed with respect to the corresponding other portion. Through the delay a shift of the loudspeaker axis 16 to the ear axis 20, which is indicated by a shift angle 38, may compensate such that the sound impression for the listener is equal or nearly equal to when the electrical device 30 is in front of the listener 28. With the signal delay a signal propagation delay time of the loudspeaker sound for the listener may be compensated.

Figure 10:
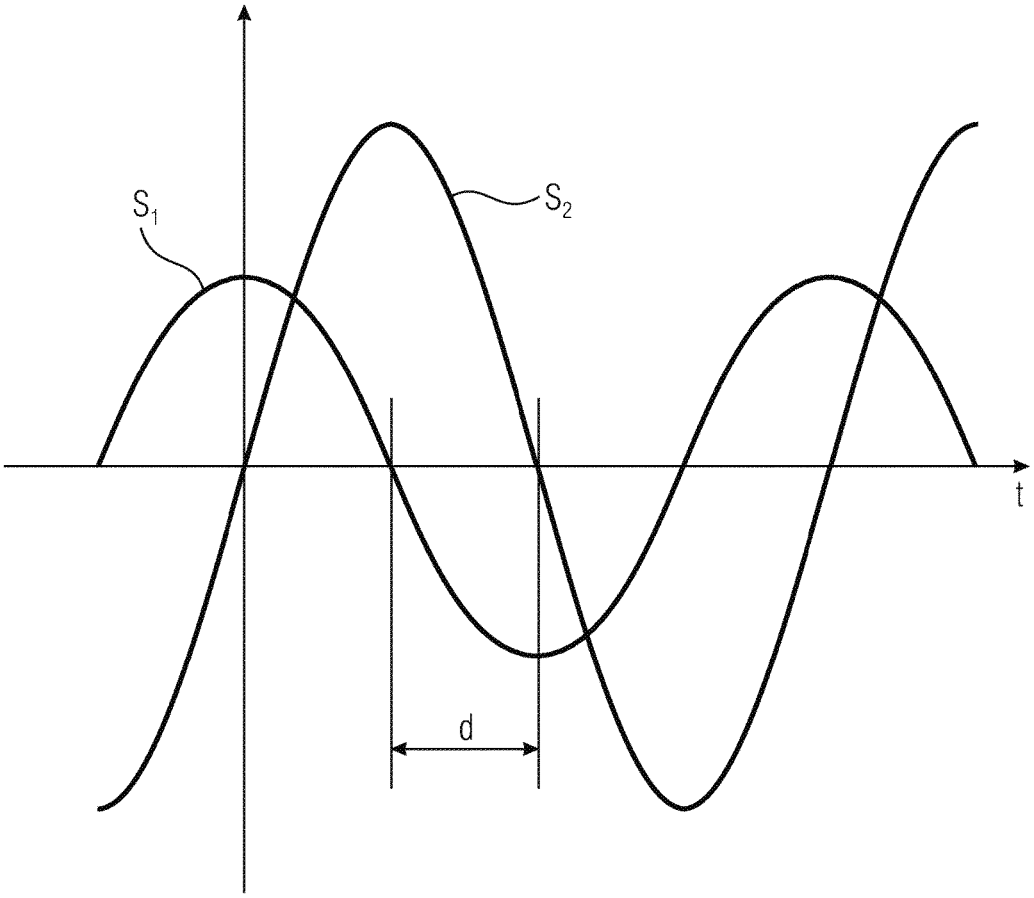
FIG. 10 shows a first signal and an amplified signal.

FIG. 10 shows a first signal S1 and an amplified signal S2. The first signal S1 may be an input audio signal. The second signal S2 may be an output channel. The second signal S2 comprises a delay to this first signal S1 which may be a signal propagation delay time. The delay may be suited to compensate a shift of the electrical device on the loud speaker axis with regard to a listener.

To generate a delay between the first output channel and the second output channel or the second output channel and the first output channel, the audio processor may be configured to use complex numbers as gain values.

In other words, the invention relates to a multimedia playback on electrical devices with built-in loudspeakers benefits from two or more loudspeakers. A sound stage is created that matches the content, e.g. sound events from the left side are played back mostly from the left speaker.

However, such devices can also be used in a vertical orientation by an automatical 90° flip of the video content. However, in state of the art devices, the audio content stays unchanged. This leads to a wrong perceptual impression of sound event.

Instead of coming from left or right, audio sources appear e.g. on top of the video. That leads to a drop in perceptual quality.

With the introduction of new multichannel audio formats (esp. with height channels), a new mixing procedure becomes mandatory. This invention describes a way to process the stereo or multichannel audio input for playback on rotated devices.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio processor comprising:

an input interface configured for receiving at least two input audio channels, each of the at least two input audio channels being associated with a predetermined reproduction position of two loudspeakers on a loudspeaker axis being a shortest distance between the two loudspeakers;

a detector interface configured for receiving a position signal indicating an information on a position of the two loudspeakers with respect to an ear axis of a listener, wherein an angle is formed between the ear axis and the loudspeaker axis, the angle being greater than 0° and lower than 180°, wherein the position signal indicates the angle;

a mixer configured for mixing the at least two input audio channels to acquire two output channels depending on the position signal; and an output interface configured for outputting the two output channels to the two loudspeakers, wherein the input interface is configured to receive a left channel as a first input audio channel of the at least two input audio channels, a right channel as a second input audio channel of the at least two input audio channels, an upper left channel as a third input audio channel of the at least two input audio channels and an upper right channel as a fourth input audio channel of the at least two input audio channels, wherein the mixing is performed such that, when the angle has a value between 0° and 90°, a portion of the upper left channel in a first output channel of the two output channels is greater than a portion of the right channel in the first output channel of the two output channels, and a portion of the right channel in a second output channel of the two output channels is greater than a portion of the upper left channel in the second output channel of the two output channels, and, when the angle has a value between 90° and 180°, a portion of the upper right channel in the first output channel of the two output channels is greater than a portion of the left channel in the first output channel of the two output channels and the portion of the left channel in the second output channel of the two output channels is greater than a portion of the upper right channel in the second output channel of the two output channels, or wherein the input interface is configured to receive a left channel as a first input audio channel of the at least two input audio channels, a right channel as the second input audio channel of the at least two input audio channels, and an upper channel as a third input audio channel of the at least two input audio channels, wherein the mixing is performed such that, when the angle has a value between 0° and 90°, a portion of the upper channel in a first output channel of the two output channels is greater than the portion of the right channel in the first output channel of the two output channels and the portion of the right channel in a second output channel of the two output channels is greater than the portion of the upper channel in the second output channel of the two output channels and, when the angle has a value between 90° and 180°, the portion of the upper channel in the first output channel of the two output channels is greater than the portion of the left channel in the first output channel of the two output channels and the portion of the left channel in the second output channel of the two output channels is greater than the portion of the upper channel in the second output channel of the two output channels, or wherein the input interface is configured to receive a left channel as a first input audio channel of the at least two input audio channels, a right channel as a second input audio channel of the at least two input audio channels, an upper left channel as a third input audio channel of the at least two input audio channels, and an upper right channel as a fourth input audio channel of the at least two input audio channels, wherein the mixer is configured to generate, for the angle equal to 90°, a first output channel of the two output channels which comprises in total a portion of more than 30% from the third input audio channel and more than 30% from the fourth input audio channel, and a second output channel of the two output channels which comprises in total a portion of more than 30% from the first input audio channel and more than 30% from the second input audio channel, or wherein the input interface is configured to receive a left channel as a first input audio channel of the at least two input audio channels, a right channel as a second input audio channel of the at least two input audio channels, and an upper channel as a third input audio channel of the at least two input audio channels, wherein the mixer is configured to generate, for the angle equal to 90°, a first output channel of the two output channels which comprises the third input audio channel, and a second output channel of the two output channels which comprises a combination of the first input audio channel and the second input audio channel.

2. The audio processor according to claim 1, wherein the input interface is configured to receive the left channel as the first input audio channel and the right channel as the second input audio channel, wherein a portion of the left channel in the first output channel of the two output channels is greater than a portion of the right channel in the first output channel of the two output channels, when the angle has a value between 0° and 90°, and a portion of the right channel in the second output channel of the two output channels is greater than a portion of the left channel in the second output channel of the two output channels, when the angle has a value between 0° and 90°, and the portion of the right channel in the first output channel of the two output channels is greater than the portion of the left channel in the first output channel of the two output channels, when the angle has a value between 90° and 180°, and the portion of the left channel in the second output channel of the two output channels is greater than the portion of the right channel in the second output channel of the two output channels, when the angle has a value between 90° and 180°.

3. The audio processor according to claim 1, wherein the mixer is configured so that the portion of the second input channel in the first output channel of the two output channels or the portion of the first input channel in the second output channel of the two output channels or the portion of the first input channel in the first output channel of the two output channels or the portion of the second input channel in the second output channel of the two output channels is delayed with respect to the corresponding other portion.

4. The audio processor according to claim 1, wherein the mixer comprises a matrix processor comprising variable matrix elements, wherein the variable matrix elements are adapted based on the position signal.

5. The audio processor according to claim 4, wherein the matrix processor is configured to use complex matrix elements.

6. The audio processor according to claim 1, wherein the mixer comprises a first adder configured for adding a first processed first input audio channel and a third processed second input audio channel, and a second adder configured for adding a second processed first input audio channel and a fourth processed second input audio channel, wherein the first processed first input audio channel is processed using a first processor comprising a first gain value, wherein the second processed first input audio channel is processed using a second processor comprising a second gain value, wherein the third processed second input audio channel is processed using a third processor comprising a third gain value, wherein the fourth processed second input audio channel is processed using a fourth processor comprising a fourth gain value, wherein the first and fourth gain values decrease for the angle having a value between 45° and 135° and the second and the third gain values increase for the angle having a value between 45° and 135°.

7. A electrical device comprising:

the audio processor according to claim 1;

the two loudspeakers; and a detector configured for detecting the information on the position of the two loudspeakers with respect to the ear axis of the listener and configured for generating the position signal which is coupled to the detector interface.

8. A method for audio processing, comprising:

receiving at least two input audio channels, each of the at least two input audio channels being associated with a predetermined reproduction position of two loudspeakers on a loudspeaker axis being a shortest distance between the two loudspeakers;

receiving a position signal indicating an information on a position of the two loudspeakers with respect to an ear axis of a listener, wherein an angle is formed between the ear axis and the loudspeaker axis, the angle being greater than 0° and lower than 180°°, wherein the position signal indicates the angle;

mixing the at least two input audio channels to acquire two output channels depending on the position signal; and outputting the two output channels to the two loudspeakers, wherein a left channel is received as a first input audio channel of the at least two input audio channels, a right channel is received as a second input audio channel of the at least two input audio channels, an upper left channel is received as a third input audio channel of the at least two input audio channels and an upper right channel is received as a fourth input audio channel of the at least two input audio channels, wherein the mixing is performed such that, when the angle has a value between 0° and 90°, a portion of the upper left channel in a first output channel of the two output channels is greater than the portion of the right channel in the first output channel of the two output channels, and the portion of the right channel in a second output channel of the two output channels is greater than a portion of the upper left channel in second output channel of the two output channels, and, when the angle has a value between 90° and 180°, a portion of the upper right channel in the first output channel of the two output channels is greater than the portion of the left channel in the first output channel of the two output channels and the portion of the left channel in second output channel of the two output channels is greater than the portion of the upper right channel in second output channel of the two output channels, or wherein a left channel is received as a first input audio channel of the at least two input audio channels, a right channel is received as a second input audio channel of the at least two input audio channels, and an upper channel is received as a third input audio channel of the at least two input audio channels, wherein the mixing is performed such that, when the angle has a value between 0° and 90°, a portion of the upper channel in a first output channel of the two output channels is greater than the portion of the right channel in the first output channel of the two output channels and the portion of the right channel in a second output channel of the two output channels is greater than the portion of the upper channel in second output channel of the two output channels and, when the angle has a value between 90° and 180°, the portion of the upper channel in the first output channel of the two output channels is greater than the portion of the left channel in the first output channel of the two output channels and the portion of the left channel in second output channel of the two output channels is greater than the portion of the upper channel in second output channel of the two output channels, or wherein a left channel is received as a first input audio channel of the at least two input audio channels, a right channel is received as a second input audio channel of the at least two input audio channels, an upper left channel is received as a third input audio channel of the at least two input audio channels, and an upper right channel is received as a fourth input audio channel of the at least two input audio channels, wherein the mixing is performed such that, for the angle equal to 90°, a first output channel of the two output channels which comprises in total a portion of more than 30% from the third input audio channel and more than 30% from the fourth input audio channel, and a second output channel of the two output channels which comprises in total a portion of more than 30% from the first input audio channel and more than 30% from second input audio channel are generated, or wherein a left channel is received as a first input audio channel of the at least two input audio channels, a right channel is received as a second input audio channel of the at least two input audio channels, and an upper channel is received as a third input audio channel of the at least two input audio channels, wherein the mixing is performed such that, for the angle equal to 90°, a first output channel of the two output channels which comprises the third input audio channel, and a second output channel of the two output channels which comprises a combination of the first input audio channel and second input audio channel, are generated.

9. A non-transitory digital storage medium having stored thereon a computer program comprising program code, wherein, when the program code is running on a computer or on a processor, the method according to claim 8 is executed.

* * * * *